US008047013B2

(12) United States Patent
Ishikawa et al.

(10) Patent No.: US 8,047,013 B2
(45) Date of Patent: Nov. 1, 2011

(54) OUTDOOR UNIT OF AIR CONDITIONER

(75) Inventors: Tetsuya Ishikawa, Fuji (JP); Mitsunobu Maezawa, Fuji (JP); Hiromasa Yamane, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 312 days.

(21) Appl. No.: 12/211,601

(22) Filed: Sep. 16, 2008

(65) Prior Publication Data

US 2009/0077988 A1 Mar. 26, 2009

Related U.S. Application Data

(63) Continuation of application No. PCT/JP2007/055550, filed on Mar. 19, 2007.

(30) Foreign Application Priority Data

Mar. 17, 2006 (JP) ..... 2006-075622

(51) Int. Cl.
*F25D 23/12* (2006.01)

(52) U.S. Cl. ..... 62/259.1

(58) Field of Classification Search ..... 62/259.1, 62/515; 700/275

See application file for complete search history.

(56) References Cited

U.S. PATENT DOCUMENTS

| | | | | |
|---|---|---|---|---|
| 3,762,907 | A * | 10/1973 | Quinn et al. | 65/164 |
| 4,698,382 | A | 10/1987 | McClure et al. | |
| 6,089,034 | A * | 7/2000 | Lake et al. | 62/204 |

FOREIGN PATENT DOCUMENTS

| | | |
|---|---|---|
| CN | 1963319 | 5/2007 |
| CN | 101000829 | 7/2007 |
| JP | 59-11478 | 1/1984 |
| JP | 63-117020 | 5/1988 |
| JP | 63-125472 | 5/1988 |
| JP | 2-46221 | 3/1990 |
| JP | 38764/1990 | 3/1990 |
| JP | 3-168544 | 7/1991 |
| JP | 2003-120963 | 4/2003 |
| JP | 2003-240277 | 8/2003 |
| JP | 2005-69582 | 3/2005 |
| JP | 2005-76925 | 3/2005 |
| JP | 72005-77016 | 3/2005 |
| JP | 2007-132606 | 5/2007 |
| JP | 2007-218534 | 8/2007 |

OTHER PUBLICATIONS

English Language Translation of JP-2005-69582.
English Language Translation of JP-2005-76925.
English Abstract of JP-3-168544.
English Language Translation of JP-2005-77016.
English Language Translation of JP-2003-120963.

(Continued)

*Primary Examiner* — Melvin Jones
(74) *Attorney, Agent, or Firm* — DLA Piper LLP US

(57) ABSTRACT

To improve operation efficiency and safety at the time of trial run after installation and inspection, an outdoor unit includes a casing, a box provided within the casing, a main control board which is disposed along a perpendicular direction within the casing and at least on a forward side and a deep side such that they overlap each other, a fan motor driving board and a noise filter board, wherein the main control board is provided to be rotatable to the forward side with its bottom side as a fulcrum point.

4 Claims, 8 Drawing Sheets

OTHER PUBLICATIONS

International Search Report of PCT/JP2007/055550.
International Preliminary Report on Patentability issued in Application No. PCT/JP07/055550 mailed Oct. 30, 2008.
Office Action issued in Japanese Appl 2008-506297 on Oct. 8, 2010.
English Language Translation of Office Action issued in Japanese Appl 2008-506297 on Oct. 8, 2010.
Office Action issued in Chinese Appl 200880003241.4 on Jan. 6, 2011.
English Translation of Office Action issued in Chinese Appl 200880003241.4 on Jan. 6, 2011.
English Language Abstract of CN 101000829 published Jul. 18, 2007.
English Language Abstract of CN 1963319 published May 16, 2007.
English abstract of JP-3-168544 published Jul. 22, 1991.
Image File Wrapper of U.S. Appl. No. 12/727,779 as of Aug. 26, 2010.
English Language Abstract of JP 02-046221 published Feb. 15, 1990.
English Language Abstract of JP 2007-218534, published Aug. 30, 2007.
Machine English Language Translation of JP 2007-218534, published Aug. 30, 2007.
English Language Abstract of JP 2007-132606, published May 31, 2007.
Machine English Landuage Translation of JP 2007-132606, published may 31, 2007.
Written Opinion of the International Searching Authority of PCT/JP2008-067168, dated Dec. 16, 2008.
International Search Report of PCT/JP2008/067168, dated Dec. 16, 2008.
English Language Abstract of JP 2003-240277, published Aug. 27, 2003.
Machine English Language Translation of JP 2003-240277, published Aug. 27, 2003.
International Preliminary Report on Patentability (IPRP) issued in PCT/JP2008/067168 on May 14, 2010.
Office Action issued in JP Appl 2008-506297 on May 26, 2010.
English Translation of Office Action issued in JP Appl 2008-506297 on May 26, 2010.
English Language Abstract of JP 2005-69582 published Mar. 17, 2005.
English Language Abstract of JP 2005-76925 published Mar. 24, 2005.
English Language Abstract of JP 2005-77016 published Mar. 24, 2005.
English Language Abstract of JP 2003-120963 published Apr. 23, 2003.
Japanese Office Action issued in JP 2009-516770 on May 24, 2011.
English Language Translation of Japanese Office Action issued in JP 2009-516770 on May 24, 2011.

* cited by examiner

OUTDOOR UNIT OF AIR CONDITIONER

CROSS REFERENCE TO RELATED APPLICATIONS

This is a Continuation application of PCT Application No. PCT/JP2007/055550, filed Mar. 19, 2007, which was published under PCT Article 21(2) in Japanese.

This application is based upon and claims the benefit of priority from prior Japanese Patent Application No. 2006-075622, filed Mar. 17, 2006, the entire contents of which are incorporated herein by reference.

BACKGROUND OF THE INVENTION

1. Field of the Invention

The present invention relates to an outdoor unit of an air conditioner, and more particularly to arrangement of a control board in a control unit equipped with electrical components.

2. Description of the Related Art

Conventionally, the outdoor unit of the air conditioner includes a control unit equipped with a control board containing electrical components for controlling a compressor, electric expansion valve and the like. For example, there has been disclosed a type in which a first control board is disposed on a deep side of an electrical component box in order to miniaturize the electrical component box while a second control board is disposed on a forward side (see Jpn. Pat. Appln. KOKAI Publication No. 2005-69582, for example).

Another type has been disclosed in which the electrical component unit is divided in such a manner that the first electrical component unit including electrical components never scheduled to be moved such as an inverter or a reactor is provided above a machine compartment and a second electrical component unit including electrical components such as a microcomputer is provided below it, while the second electrical component unit can be opened/closed like a door with one side along a perpendicular direction (left side end face) of the second electrical component unit acting as a rotation axis and the second electrical component unit can be moved to access refrigerant circuit components (see Jpn. Pat. Appln. KOKAI Publication No. 2005-76925).

BRIEF SUMMARY OF THE INVENTION

The control unit accommodated in the above-mentioned outdoor unit of the air conditioner has a following problem. According to the structure described in Jpn. Pat. Appln. KOKAI Publication No. 2005-69582, the first control board is disposed on the deep side of the electrical component box and the second control board is disposed on the forward side. As a result, when the first control board disposed on the deep side is inspected and repaired, the second control board on the forward side needs to be removed from the electrical component box, thereby keeping the operation efficiency low.

On the other hand, in the structure described in Jpn. Pat. Appln. KOKAI Publication No. 2005-76925, the electrical component unit is divided and disposed on upper and lower sections. Thus, the two electrical component units need to be installed at the time of assembly of the outdoor unit, thereby keeping the assembly efficiency low. Further, there is a fear that the second electrical component unit may move during a maintenance operation thereby obstructing the maintenance operation.

Accordingly, an object of the present invention is to provide an outdoor unit of air conditioner capable of improving the work efficiency at the time of trial run and inspection after installation.

To solve the above-described problem and achieve the object, the outdoor unit of the air conditioner of the present invention is configured as follows.

The present invention comprises a unit casing, a control unit casing provided in the unit casing and a plurality of control boards disposed along a perpendicular direction within the control unit casing such that they overlap on a forward side and deep side, each of the control boards being equipped with electrical components, wherein the control board provided on the most forward side of said plurality of control boards is rotatable to the forward side with its bottom side as a fulcrum point and capable of being stopped at a predetermined angle.

DETAILED DESCRIPTION OF THE INVENTION

Figure 1:
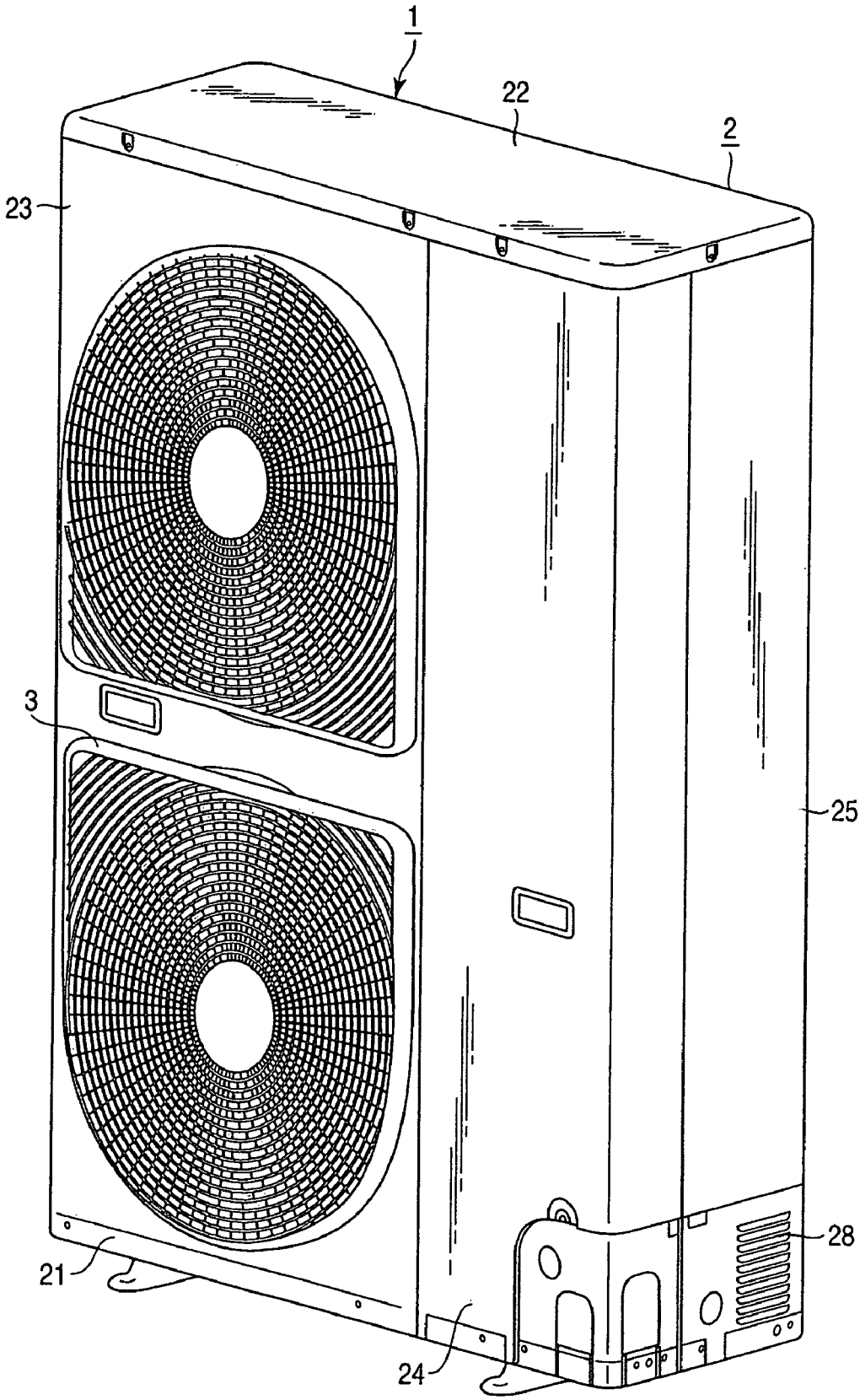
FIG. 1 is a perspective view showing an appearance of an outdoor unit according to an embodiment of the present invention.
Figure 2:
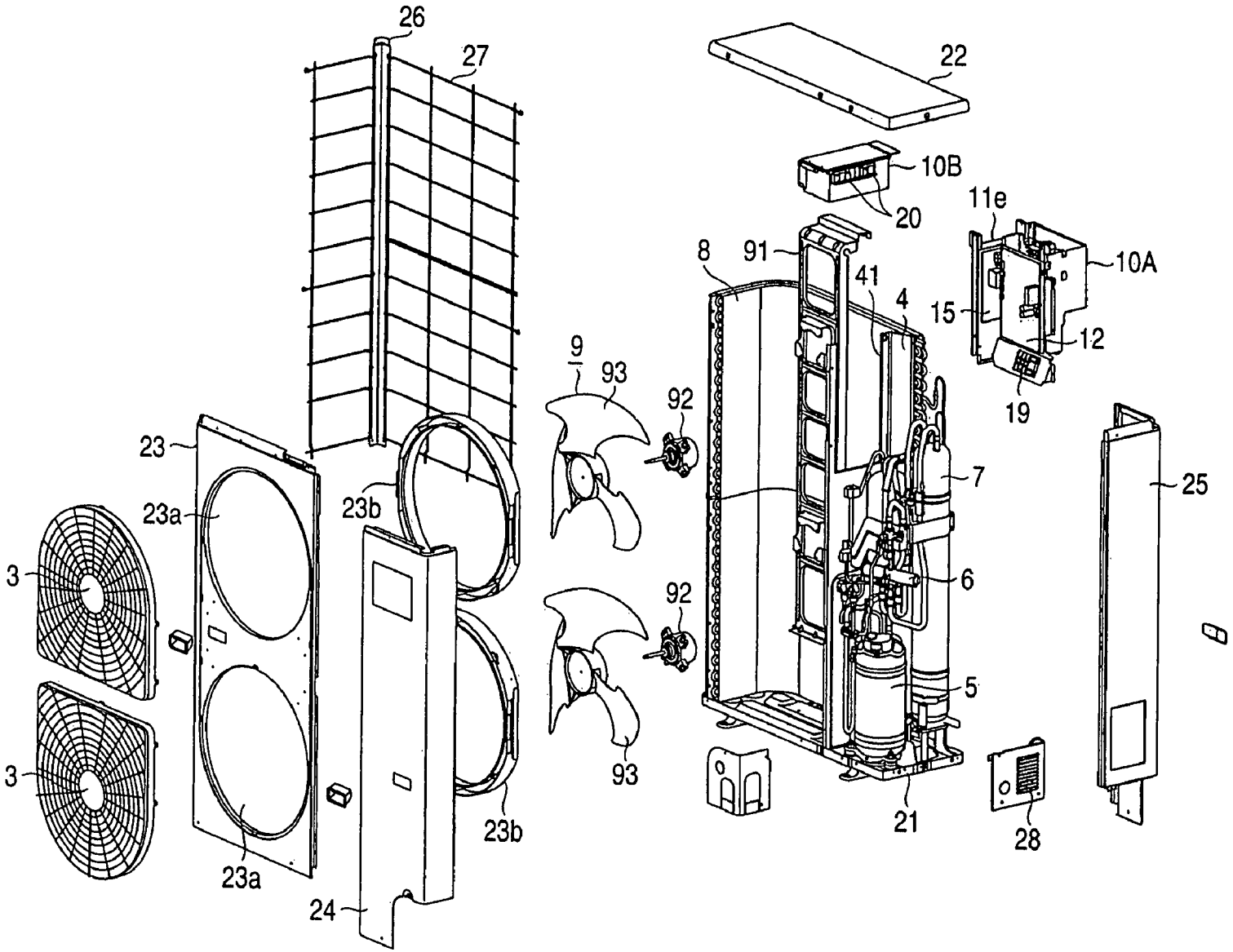
FIG. 2 is a perspective view showing the outdoor unit in a disassembled state.
Figure 3:
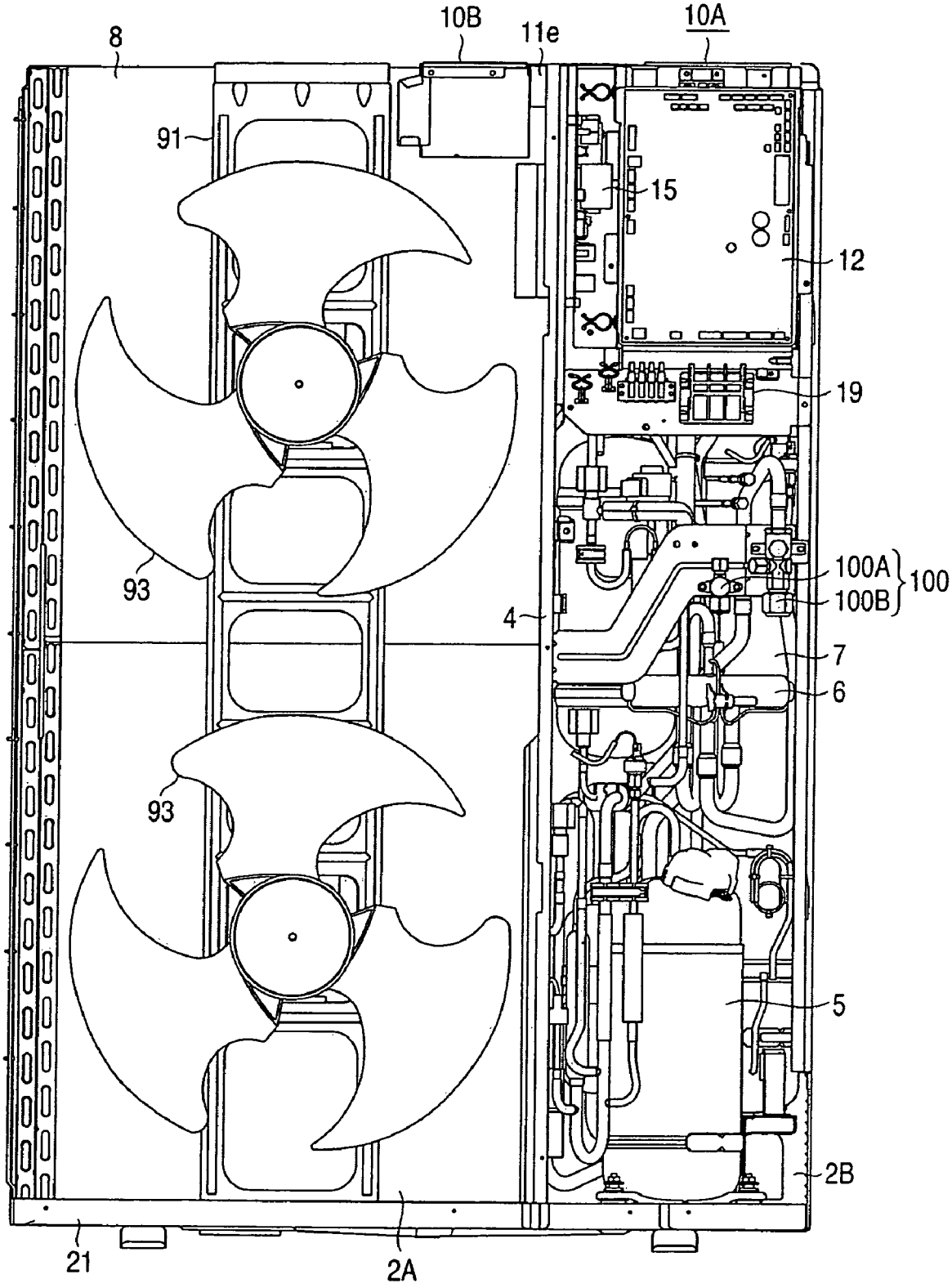
FIG. 3 is a front view showing the internal structure of the outdoor unit.
Figure 4:
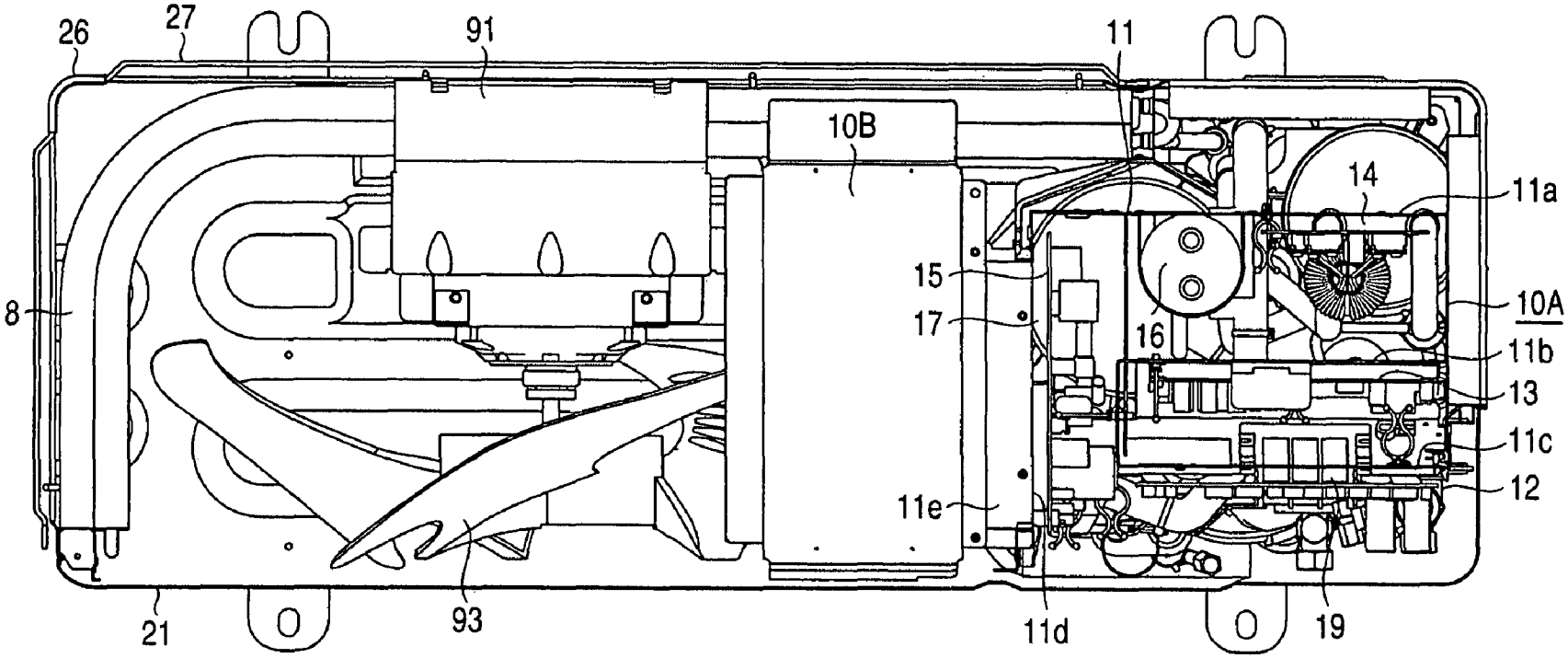
FIG. 4 is a plan view showing the internal structure of the outdoor unit.
Figure 5:
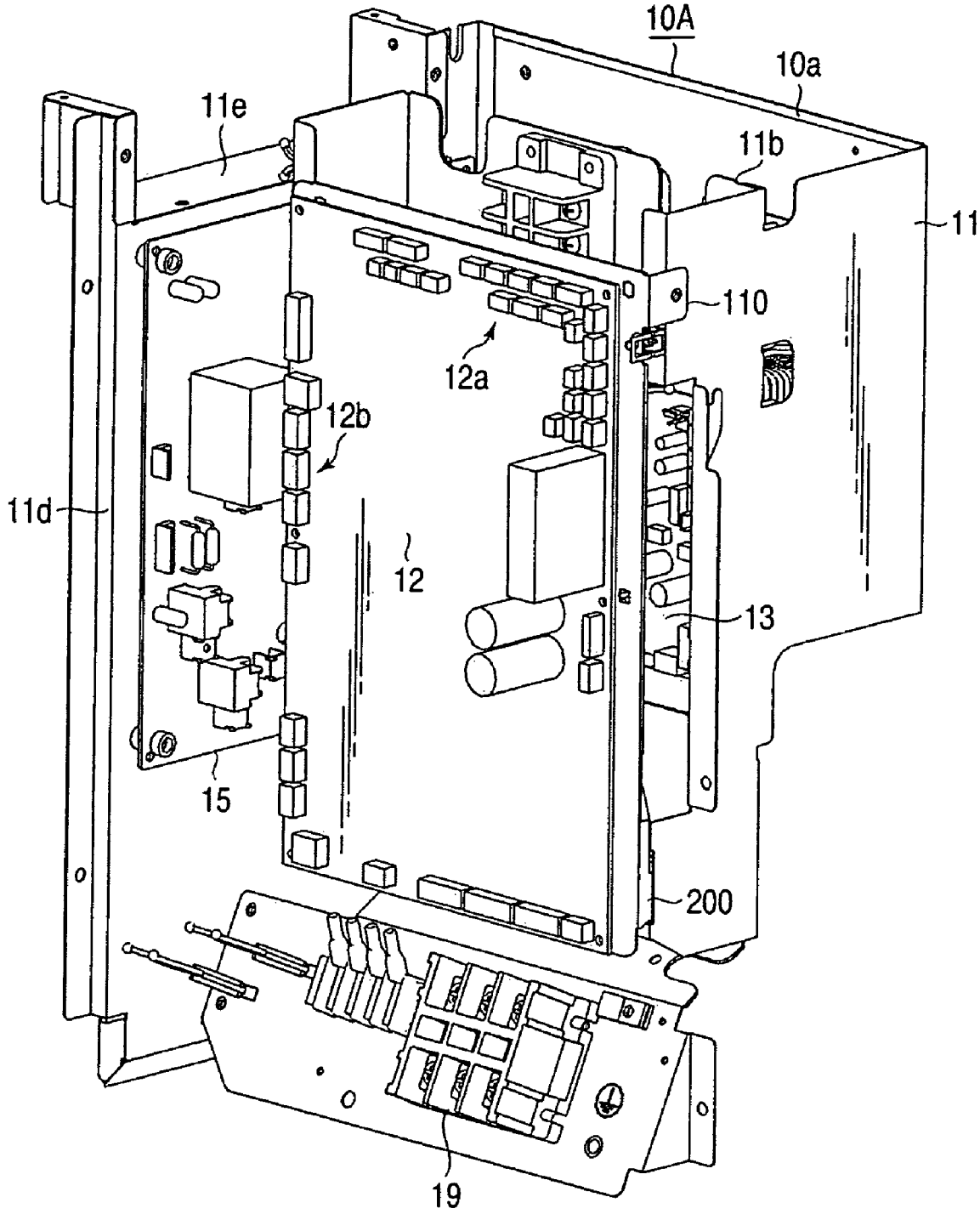
FIG. 5 is a perspective view showing a control unit built in the outdoor unit.
Figure 6:
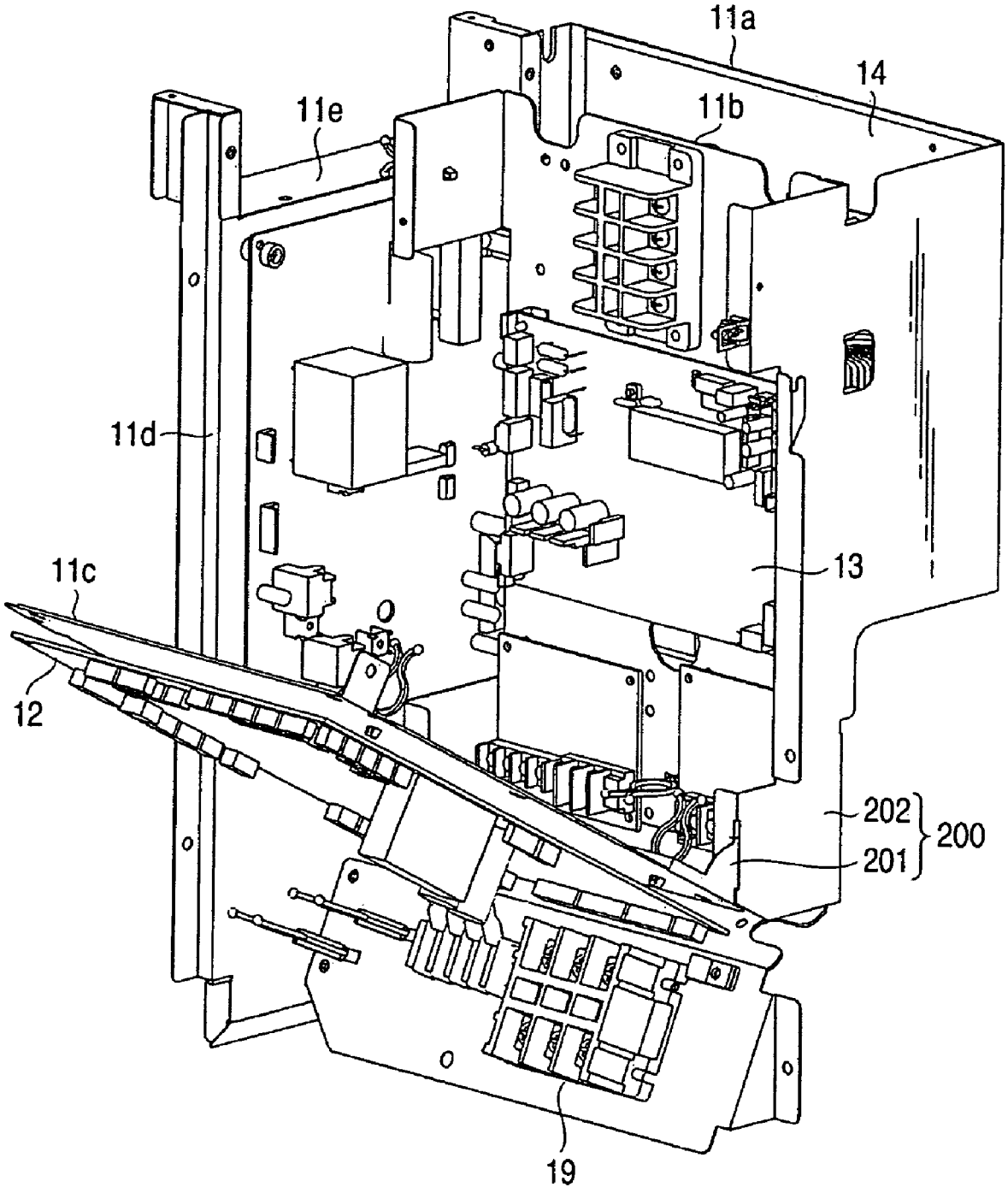
FIG. 6 is a perspective view showing a state in which a main board built in the control unit is opened.
Figure 7:
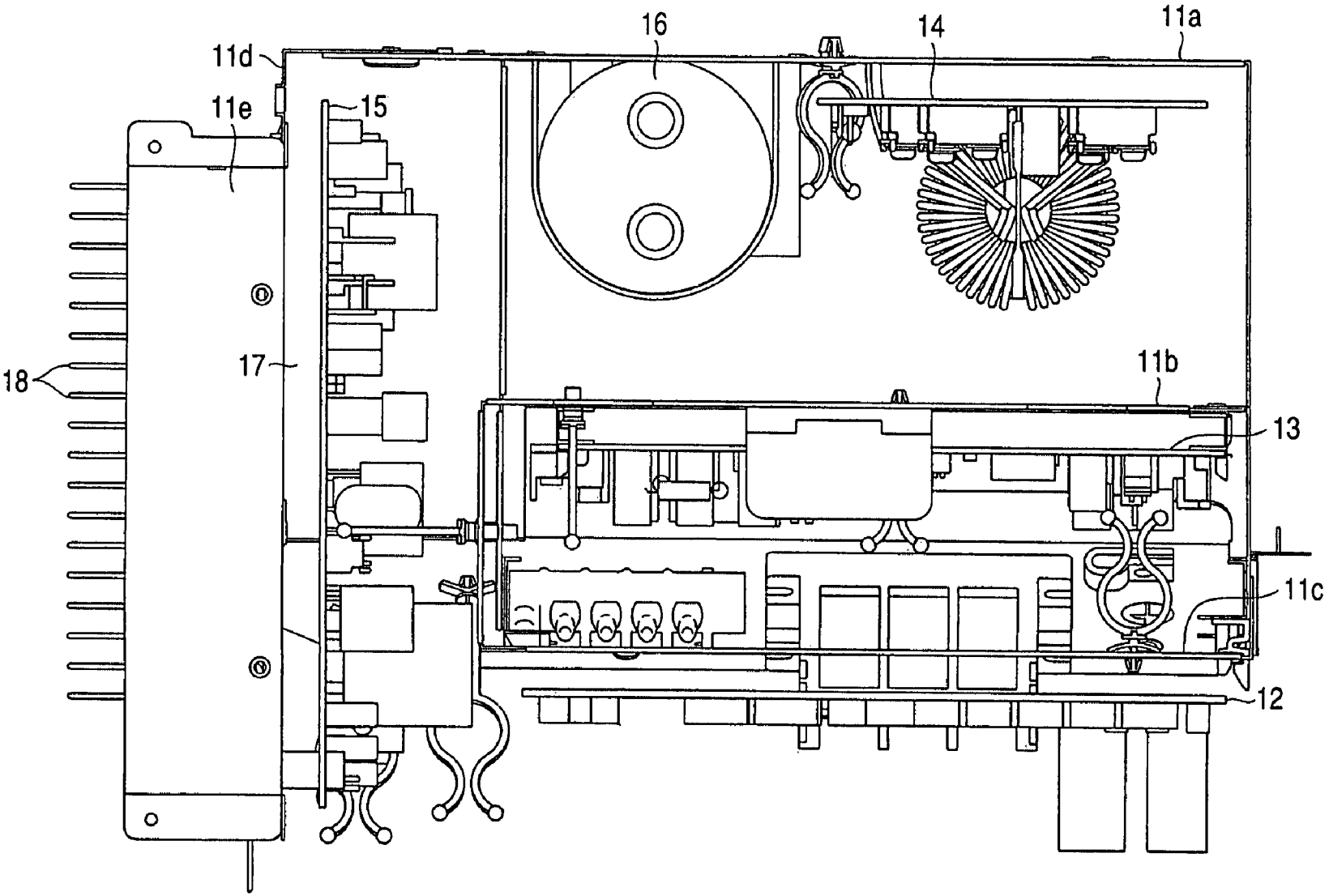
FIG. 7 is a plan view showing the control unit.
Figure 8:
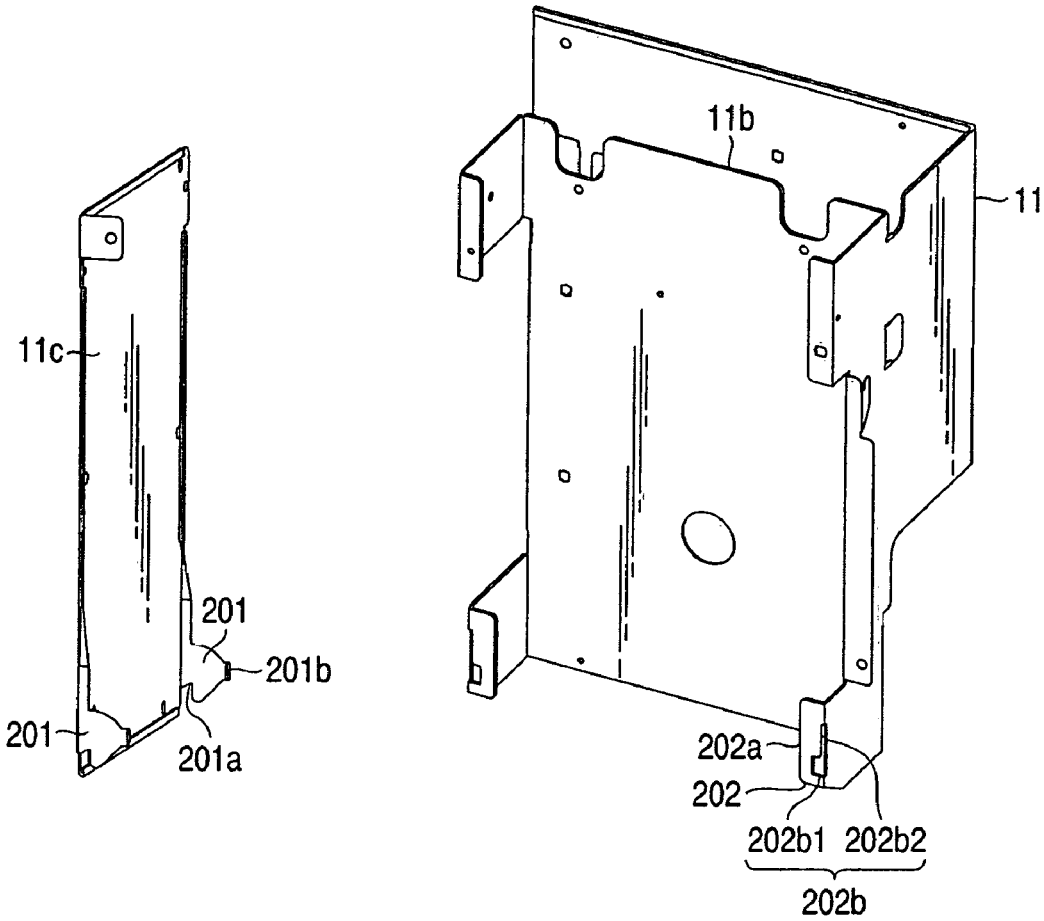
FIG. 8 is a perspective view showing an opening/closing structure of the main board.
Figure 9:
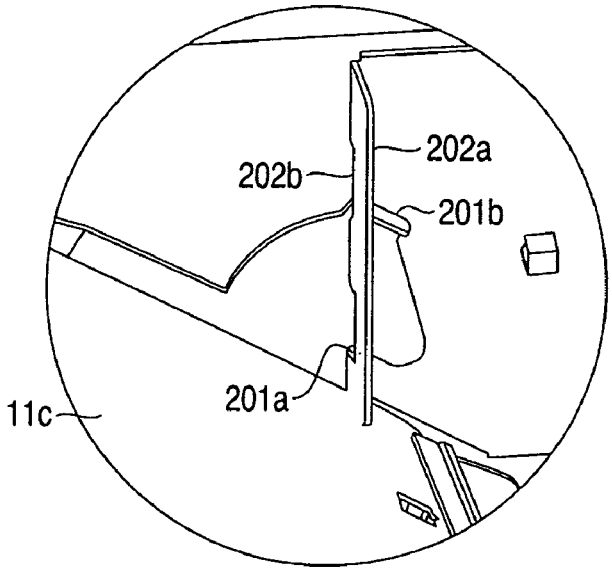
FIG. 9 is a perspective view showing major portions of the opening/closing structure.

FIG. 1 is a perspective view showing an appearance of an outdoor unit 1 according to an embodiment of the present invention. FIG. 2 is a perspective view showing the outdoor unit 1 in a disassembled state FIG. 3 is a front view showing the internal structure of the outdoor unit 1. FIG. 4 is a plan view showing the internal structure of the outdoor unit 1. FIG. 5 is a perspective view showing a control unit 10A built in the outdoor unit 1. FIG. 6 is a perspective view showing a state in which a main board 12 in FIG. 5 is opened. FIG. 7 is a plan view showing the control unit 10A. FIG. 8 is a perspective view showing an opening/closing structure of the main board 12 built in the control unit 10A. FIG. 9 is a perspective view showing major portions of the opening/closing structure.

Reference number 1 in FIG. 1 denotes an outdoor unit of the air conditioner, reference number 2 denotes a casing (unit casing) and reference number 3 denotes an exhaust grille (fan guard).

As shown in FIG. 2, the casing 2 includes a bottom plate 21, a ceiling plate 22, a front plate 23, a front side plate 24, a rear side plate 25, a supporting post 26 and a fin guard 27. Reference number 28 in FIG. 1 denotes an air intake port. The front plate 23 has two exhaust ports 23*a* and 23*b*, the exhaust grilles 3 are attached so as to cover these exhaust ports 23*a* and 23*b*, and bell mouths 23*b* are mounted inside.

As shown in FIG. 3, the interior compartment of the outdoor unit 1 is divided to a machine room 2A and a heat exchanger room 2B by a partitioning plate 4. The partitioning plate 4 is provided in a perpendicular direction from the bottom plate 21 to the ceiling plate 22. As shown in FIG. 2, the partitioning plate 4 has a cutout portion 41 at its upper portion. A control unit 10A described later is mounted on this cutout portion 41.

An electric expansion valve and refrigerating cycle components such as refrigerant tank are disposed in the machine room 2A as well as a compressor 5, a four-way valve 6, and an accumulator 7. The control unit 10A is disposed in a space above these refrigerating cycle components. A pipe connecting portion 100 (liquid side connection portion 100*a*, gas side connecting portion 100*b*), to which one end side of the refrigerant pipe connecting the outdoor unit 1 with an indoor unit (not shown) is connected, is provided on the front face side of the machine room 2A.

A heat exchanger 8 and a blower 9 are disposed in the heat exchanger room 2B. The heat exchanger 8 is provided in an L-shaped configuration as seen in a plan view such that it faces the rear face side and one side face of the outdoor unit 1. The blower 9 is constituted of a motor base 91, two fan motors 92 and two fans 93. The leg portion of the motor base 91 is fixed to the bottom plate 21 and the top portion thereof is fixed to the heat exchanger 8 while the motor base 91 has a motor fixing portion for fixing the fan motor 92 in a vertical direction. The fan 93 is rotated clockwise in FIG. 3 so as to feed air from the rear face side of the outdoor unit 1 to the front exhaust port 23*a*.

The control unit 10A has a plurality of control boards 12 to 15 provided in a perpendicular direction and a box (control unit casing) 11 for accommodating these boards.

The box 11 has a triplex structure which is made of sheet metal while its top and bottom are open. A noise filter board 14 and an electrolytic capacitor 16, which are electrical components driven by a high voltage (for example, 280V) are mounted on the side plate 11*a* on a deepest side (rear face side of the outdoor unit 1) of the box 11.

A fan motor driving board (fan driving inverter unit) 13 which is driven by a high voltage is mounted on an intermediate plate 11*b* in the middle position. The main control board 12 for controlling the operation of the air conditioner is provided on the side plate 11*c* located on the most forward side. Electrical components mounted on this main board 12 are mainly driven by a low voltage of 5V to 15V.

A compressor driving board (compressor inverter unit) 15 is provided on the side plate 11*d* on the partitioning plate 4 side of the box 11. A power transistor module 17 is mounted on the rear side (partitioning plate 4 side) of this compressor driving board 15 and a radiating fin 18 is mounted via the side plate 11*d*. The side plate 11*d* corresponds to the cutout portion 41 in the partitioning plate 4 and when the control unit 10 is mounted on the partitioning plate 4, the radiating fin 18 is disposed within the heat exchanger room 2B as shown in FIG. 7.

The compressor driving board 15 is equipped with electrical components which are driven by a high voltage (for example, 280V). Because most of the compressor driving board 15 is disposed on the deep side of the main board 12, the hand is kept from touching the compressor driving board 15 during an operation of the main board 12.

As shown in FIG. 5, a terminal base 19 is provided on the bottom portion of the main board 12 such that it is tilted and directed upward. Commercial power is connected to the control unit 10A through this terminal base 19. Commercial power connected to the terminal base 19 is rectified by the noise filter board 14. This terminal base 19 is dangerous because commercial power current flows thereto. However, the hand is kept from touching the terminal base 19 during an operation of the main board 12 because it is provided apart from the main board 12.

The box 11 has a movable portion 200 for the main board 12 to move to the front side of the casing with its bottom portion as a fulcrum point. A hook piece 201 is formed on each of both side portions on the bottom end of the side plate 11*c* by being bent. A lock portion 202 which locks the hook piece 201 is provided on the bottom of the box 11.

The hook piece 201 on the side plate 11*c* has a concave portion 201*a* and a hook pawl 201*b* which is formed by bending its front end portion inward.

The lock portion 202 has a bent piece 202*a* formed by bending its front end inward and a slit 202*b* provided in the bent piece 202*a*.

The slit 202*b* is constituted of an insertion hole portion 202*b*1 in which the hook pawl 201*b* of the hook piece 201 is to be inserted and a slide hole portion 202*b*2 in which the hook piece 201 is slidable. This slide hole portion 202*b*2 is provided in a smaller width than the insertion hole portion 202*b*1.

If the hook pawl 201*b* of the hook piece 201 is inserted into the insertion hole portion 202*b*1 in the lock portion 202 and further pressed, the hook piece 201 is moved upward along the slide hole portion 202*b*2 and inserted into the slit 202*b* while the concave portion 201*a* of the hook piece 201 is locked into the bent piece 202*a* of the lock portion. With this state, the fixing piece 110 provided on the side plate 11*c* is fixed to the box 11 with a fixing tool such as a screw.

When opening the side plate 11*c*, the fixing tool such as a screw is removed and the upper section of the side plate 11*c* is pulled forward. Consequently, the side plate 11*c* is rotated about the concave portion 201*a* of the hook piece 201. The hook pawl 201*b* of the hook piece 201 comes into contact with the bent piece 202*a* of the lock portion 202 so that the hook pawl 201*b* functions as a stopper thereby restricting a further rotation thereof. Then, the main board 12 and the side plate 11*c* are stopped in an open state due to their own weights. A duct portion 11*e* which communicates with the heat exchanger room 2B is provided on the upper section of the box 11 and a reactor accommodating box 10B for accommodating a reactor 20 (see FIG. 2) is provided on the heat exchanger room 2B side of the duct portion 11*e*.

The outdoor unit 1 of the air conditioner having such a structure has following advantages in trial run after installation, inspection and maintenance. That is, because the main board 12 is rotatable, the inspection work for the fan motor driving board 13 and the compressor driving board 15 disposed on a deep side can be carried out without removing the main board 12. Additionally, the rotation of the main board 12 is limited to a predetermined angle and stopped. Thus, no additional force is applied to various wires connected to the main board 12 or no such wires are made loose. During an operation, the main board 12 is rarely an obstacle to that operation because it never moves by itself.

If the rotation fulcrum point of the main board 12 is disposed on any side portion of the right and left sides of the board it is necessary to concentrate various wires to a side which serves as a fulcrum point so that the rotation is never obstructed. In that case, an AC power line for supplying power to the two-way valve, and the four-way valve 6, a DC power line for supplying power to an electric expansion valve (PMV) and signal lines of various sensors such as a temperature sensor approach each other, so that the electric expansion valve can malfunction or noise rides on the sensor signal line due to influences from the AC power line. According to this embodiment, the main board 12 is rotated about a bottom portion and the AC power line and the DC power line are wired separately on the right and left sides of the main board 12. Then, the DC power connectors 12*a* to which the DC power line and various sensors are to be connected are concentrated to the left side of the main board 12, and the AC power connectors 12*b* are concentrated to the right side of the main board 12, thereby facilitating a noise countermeasure so as to improve reliability.

When the operation of the air conditioner is started and the blower 9 is driven, the pressure in the heat exchanger room 2B becomes negative, so that air flowing in from the air intake port 28 provided in the casing 2 flows from the machine room 2A to the heat exchanger room 2B side via the duct portion 11*e*. This air flow cools the interiors of the control unit 10A and the reactor accommodating box 10B.

Because the reactor 20 which is heated to a high temperature is disposed on the heat exchanger room 2B side, the control unit 10A can be miniaturized and the reactor 20 can be cooled efficiently. Further, because the noise filter 14 and electrolytic capacitor 16 which are driven with a high voltage are disposed on the upper section of the accumulator 7 which has a lower temperature than other components accommodated in the machine room 2A, the cooling effect is improved further.

As described above, according to the outdoor unit 1 of the air conditioner of this embodiment, when the control board on the deep side is inspected or repaired, the control board located on the forward side does not need to be removed, thereby improving operation efficiency. Further, the wire on which noise is likely to ride and the sensor signal line are disposed separately, thereby improving reliability. Further, installation work of the control unit is facilitated due to its multiple structure.

In the meantime, the present invention is not restricted to the above-described embodiments and needless to say, may be modified in various ways within a scope not departing from the gist of the present invention.

The present invention makes it possible to improve the efficiency of a trial run and inspection after the installation of an outdoor unit of an air conditioner.

What is claimed is:

1. An outdoor unit of an air conditioner, comprising:

a unit casing;

a control unit casing provided in the unit casing; and a plurality of control boards disposed along a perpendicular direction within the control unit casing such that they overlap on a forward side and deep side, each of the control boards being equipped with electrical components, wherein the control board provided on a most forward side of said plurality of control boards is rotatable to the forward side with its bottom side as a fulcrum point and capable of being stopped at a predetermined angle.

2. The outdoor unit of an air conditioner according to claim 1, wherein of said plurality of the control boards, the control board provided on the most forward side is provided with electrical components which are driven with a lower voltage than that for electrical components mounted on the control board provided on the deep side.

3. The outdoor unit of an air conditioner according to claim 1, wherein an interior of the unit casing is divided into a machine room and a heat exchanger room by a partitioning plate provided along a perpendicular direction, and the control unit casing has a duct portion which is disposed on a top of the machine room and communicates with the heat exchanger room, and a reactor accommodating box for accommodating the reactor is provided on the heat exchanger room side of the duct portion.

4. The outdoor unit of an air conditioner according to claim 2, wherein an interior of the unit casing is divided into a machine room and a heat exchanger room by a partitioning-plate provided along a perpendicular direction, and the control unit casing has a duct portion which is disposed on the top of the machine room and communicates with the heat exchanger room, and a reactor accommodating box for accommodating the reactor is provided on the heat exchanger room side of the duct portion.

* * * * *